US006998019B2

(12) United States Patent
Kinsley, Jr.

(10) Patent No.: US 6,998,019 B2
(45) Date of Patent: Feb. 14, 2006

(54) GLAZED PAPER WEBS

(75) Inventor: Homan B. Kinsley, Jr., Bohannon, VA (US)

(73) Assignee: FiberMark, Inc., Brattleboro, VT (US)

( * ) Notice: Subject to any disclaimer, the term of this patent is extended or adjusted under 35 U.S.C. 154(b) by 0 days.

(21) Appl. No.: 10/657,133

(22) Filed: Sep. 9, 2003

(65) Prior Publication Data

US 2004/0140075 A1 Jul. 22, 2004

Related U.S. Application Data

(60) Provisional application No. 60/409,229, filed on Sep. 10, 2002, provisional application No. 60/409,186, filed on Sep. 10, 2002.

(51) Int. Cl.
*D21F 11/00* (2006.01)

(52) U.S. Cl. ..... 162/205; 162/204; 162/146; 162/157.3; 162/138; 100/160; 100/161; 100/162 R; 100/155 R

(58) Field of Classification Search ..... 162/205, 162/204, 146, 157.3, 138; 100/160, 161, 100/162 R, 155 R
See application file for complete search history.

(56) References Cited

U.S. PATENT DOCUMENTS

| | | | | |
|---|---|---|---|---|
| 2,999,788 | A * | 9/1961 | Morgan | 162/146 |
| 3,549,789 | A * | 12/1970 | Haroldson | 174/122 R |
| 3,957,573 | A * | 5/1976 | Miyamoto et al. | 162/102 |
| 4,089,738 | A | 5/1978 | Kankaanpaa | |
| 4,128,053 | A | 12/1978 | Kankaanpaa | |
| 5,060,565 | A * | 10/1991 | Schonheit | 100/331 |

OTHER PUBLICATIONS

International Search Report dated Dec. 9, 2003.

* cited by examiner

*Primary Examiner*—Mark Halpern
(74) *Attorney, Agent, or Firm*—Buchanan Ingersoll PC

(57) ABSTRACT

Provided is a process for preparing a smooth and glossy surfaced paper web. The process comprises subjecting the paper web to shear by using calender rolls driven at different speeds or calender rolls with different diameters. The resulting paper has a totally different structure than the original paper, as it has a much smaller void structure and a much higher degree of bonding between the elements of the sheet. The process is particularly applicable to improving the electrical insulation properties of an aramid paper web.

4 Claims, No Drawings

GLAZED PAPER WEBS

CROSS REFERENCE TO RELATED APPLICATIONS

This application claims the benefit of U.S. Provisional Application Nos. 60/409,229 and 60/409,186, both filed on Sep. 10, 2002, which are both expressly incorporated by reference herein in their entirety.

BACKGROUND OF THE INVENTION

1. Field of the Invention

The present invention relates to more efficiently and effectively imparting a glossy and smooth surface to a paper web. More particularly, the present invention relates to a process using shear to impart desirable characteristics to a paper web.

2. Description of the Related Art

Compression of paper webs has been used to impart various different characteristics. These include imparting a glossy finish to a paper web or reducing the pore size of a web, such as an aramid paper web, in conjunction with heat.

Paper webs having a glossy and smooth finish are occasionally required or desired. Glazers are available and are known in the art. Such equipment does impart a glossy and smooth finish to paper webs by compressing the paper between two different curved surfaces. A combination of hard and soft rolls can also be used to provide a glossy finish. Problems occur, however, if the soft roll is damaged such that its surface is nicked or wrinkled, which can easily occur. The resulting paper is therefore damaged, which is a major problem. Being able to make a paper web having a glossy and smooth finish employing more conventional equipment, e.g., calender rolls of the same material, would be desirable. Using conventional steel calender rolls would be particularly advantageous.

Aromatic polyamide (aramid) paper is made on a fourdrenier paper machine from 0.25 inch long by 2 denier aramid fibers and aramid fibrid. The fibrid is a small irregularly shaped piece of aramid polymer that is much larger in two dimensions than it is in the third dimension. It is like a microscopic corn flake in shape. The large dimensions are on the order of 5 to 25 micrometers while the third and smaller dimension is about 0.01 to 1 micrometers. The fibrid serves as the bonding agent for the fibers. The paper made on the paper machine is surprisingly strong. However, the pore structure of the paper prevents it from reaching its maximum utility as electrical insulation. For many electrical insulation applications it is necessary to reduce the pore structure of the paper. This is done commercially by heating the paper to about 350° C. and then running the sheet through a two steel roll nip. This increases the density of the paper and reduces the pore structure. Controlled heating of the paper is difficult, and there is some thermal degradation of the fiber structure.

More specifically, the aramid paper is heated to a very high temperature so that the polymer is softened. While in this state the sheet is compressed by running it through a two steel roll nip. Pores are reduced in size by this densification. However, the structure of the sheet is unchanged. Because of this the sheet recovers some of its original shape after passing through the nip. As the sheet recovers part of its original shape there is some rebound in caliper and some increase in pore structure. Even after such a harsh step, the basic pore characteristics of the paper remain, although the pore size is much smaller due to the compression.

Accordingly, one object of the present invention is to provide a process to more effectively and efficiently impart desirable characteristics to a paper web.

Another object of the present invention is to provide a novel process for glazing a paper web.

Still another object of the present invention is to provide a process which more easily and effectively reduces the pore structure of aramid papers.

These and other objects of the present invention will become apparent upon a review of the following specification and the claims appended thereto.

SUMMARY OF THE INVENTION

The present invention provides a novel process for imparting a glossy and smooth surface to a paper web. The process of the present invention imparts shear to the surfaces of the paper web using calender rolls. In the shear calender process of the present invention, the surfaces of the web move at slightly different speeds. This is achieved by either driving the rolls at different speeds or by using rolls with different diameters. The shear calender paper is a novel product in that it has a new structure with a much higher degree of bonding between the elements of the sheet. The paper is denser, stronger, has a higher modulus, reduced equilibrium moisture content and smaller void structure than the original sheet.

In another embodiment of the present invention, there is provided a better way to reduce the pore structure of aramid paper so that it has improved properties for electrical insulation. The present invention accomplishes this by glazing the aramid paper. It has been discovered that treating the aramid paper with a glazer at room temperature can reduce the pore volume and pore size. Glazers are available and any known glazer can be used. A glazer is a device that develops shear by compressing the paper between two different curved surfaces. It is preferred that this result of reducing the pore structure of aramid paper, however, be obtained by using a shear calender, which imparts shear to the surfaces of the paper web using calender rolls as described above. Using either technique, a key advantage of the present invention is that the process of reducing the pore structure by subjecting the aramid paper to shear can be conducted at ambient temperature, and the conventional heating step is not needed.

DETAILED DESCRIPTION OF PREFERRED EMBODIMENTS

The present invention provides one with a new process for imparting a glossy and smooth surface to a paper web. The paper web can be comprised of any cellulosic or synthetic fiber materials, or a combination thereof. The web can also contain other components which are conventional, such as binders and fillers, including fibrids.

When a paper web is exposed to shear and compression in a shear calender, the paper undergoes a change in structure. The fibers that make up the sheet move out of their original position so that they fill the voids in the sheet. The paper after shear calendering has a different structure. Shear calendering allows a reduction in pore structure, both pore size and pore volume, without the need for heating the paper. The calendering can occur at ambient or room temperature.

During the shear calendering, the two surfaces of the paper web are made to move with respect to one another. The sheet is essentially reformed. The shear is achieved by either driving the calender rolls at different speeds, or by using rolls with different diameters.

With regard to different speeds, the calender rolls can be the same, and can be part of a conventional papermaking line wherein steel calender rolls are used at the end of the process. In such instances, the rolls are generally of the same diameter or size. As the paper web goes in between the calendering rolls, one roll can be driven at a different speed from the second roll, or other rolls. The difference in speed can vary, depending upon the smoothness and glossiness of the surface desired. The greater the difference in speed, generally the more shear imparted to the surfaces of the paper web.

Shear can also be imparted to the surfaces of the paper web by using rolls of a different diameter. It has been found that the effect of different size calender rolls also imparts shear to the surface of the paper web, thus providing a smooth surface. The smaller one of the calender rolls, the greater the shear imparted. The calender rolls of different size diameter can be stacked so that there are two, three or more stacked calender rolls of varying sizes to impart the shear to the surfaces of the paper web.

In a preferred embodiment, a nested shear calendering configuration is employed. The configuration preferably comprises three calender rolls arranged around a central, smaller calender roll, which can be as small as two inches in diameter. The three calender rolls can be, for example, conventional 14 inch diameter calender rolls. Various paths of the paper web through the configuration can be used. The nested configuration avoids roll deflection, particularly of the smaller roll.

The resulting glazed paper web has a totally different structure than the original paper. By using the process of the present invention, a glazed paper web having a smooth and glossy surface can be easily obtained, with the degree of gloss and smoothness being easily controlled. Both sides of the paper is generally smooth. The resulting paper also will be denser, stronger and have a smaller void structure than the original paper, as well as a smooth and glossy surface. The modulus of the paper is also improved.

The aforedescribed shear calendering process has particular applicability to aramid papers. In particular, it has been found that subjecting aramid papers to shear, especially by means of the shear calendering process of the present invention, the pore structure of the aramid sheet can be improved for purposes of its electrical insulation properties. While using the shear calendering process of the present invention is most preferred, the application of any shear to the aramid paper, e.g., by using a glazer, can provide some improvement in the pore structure of the aramid paper. The shear calendering process of the present invention, however, provides the best results.

More specifically, aramid paper has a pore structure that is created during the paper making step. There are pores between fibers and there are voids in the sheet. Once the paper is formed on a paper machine this pore structure becomes fixed and it is a characteristic of the sheet. The conventional process of heating and compressing can flatten and deform the fibers but it cannot reform the paper structure.

When exposed to shear and compression in a shear calender in accordance with the present invention, the aramid paper undergoes a change in structure. The fibers and fibrids that make up the sheet can move out of their original positions so that they can fill the voids in the sheet. The paper after shear calendering has a different structure. This is not true for conventional products available, for example, from DuPont. The conventional paper has been softened by heat and compressed so that the fibers in the sheet are pushed into the voids. However, the basic sheet structure is unchanged.

The prior art process involves heating the sheet to very high temperatures and then compressing the paper in a two roll steel nip to reduce the pore structure and increase the paper density. By using a shear calender this reduction in pore structure (both pore size and pore volume) can be achieved without heating the paper. The removal of this heating step is advantageous for reasons of cost, safety, and avoiding any thermal degradation of the polymer or the cellulose structure.

During the shear calendering the two surfaces of the paper are made to move with respect to one another. There is movement of the fibers and fibrids that comprise the sheet. The sheet is reformed. The voids are removed during this process, thus there is a reduction or an elimination of pores. The shear calendered paper is a new product. It has a new structure and it has a much higher degree of bonding between the elements of the sheet. As discussed above, the shear is achieved by either driving the calender rolls at different speeds, or by using rolls with different diameters.

The glazed aramid paper of the present invention, therefore, has a totally different structure than the original paper. It will be denser, stronger, have higher modulus, reduced equilibrium moisture content, and smaller void structure when compared to conventional heat processed aramid paper. The aramid paper that can be treated in accordance with the present invention can be any commercially available aramid paper, such as that available from DuPont, or can be made separately using different amounts of fibers and/or fibrid. Generally, the paper would contain from 50–70 wt % aramid fibers and from 30–50 wt % aramid fibrid. If desired, other fibers can be added in minor amounts, or a binder such as polyvinyl alcohol can be added. Preferably, however, the paper is comprised substantially entirely of aramid material, such as Nomex® or Kevlar®. The present invention provides one with an improved aramid paper, particularly for electrical insulation applications.

While the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A process for preparing a paper web having a glossy surface, with the paper web being subjected to sufficient shear by at least two calender rolls to create a glossy surface on the paper web, with four calender rolls being used in a nested configuration to impart the shear, the nested configuration comprising three large calender rolls surrounding a singly smaller calender roll in the center of the three larger calender rolls.

2. The process of claim 1, wherein the paper is subjected to shear at ambient temperatures.

3. The process of claim 1, wherein the paper web subjected to shear is comprised of aramid fibers.

4. The process of claims 3, wherein the paper web subjected to shear further comprises aramid fibrid.

* * * * *